US008695377B2

(12) United States Patent
Bachelier et al.

(10) Patent No.: US 8,695,377 B2
(45) Date of Patent: Apr. 15, 2014

(54) PROCESS AND APPARATUS FOR THE SEPARATION OF AIR BY CRYOGENIC DISTILLATION

(75) Inventors: Frédéric Bachelier, La Chapelle la Reine (FR); Shao-Hua Sun, Shanghai (CN)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 572 days.

(21) Appl. No.: 12/671,798

(22) PCT Filed: Aug. 10, 2007

(86) PCT No.: PCT/CN2007/002405

§ 371 (c)(1), (2), (4) Date: Jun. 24, 2011

(87) PCT Pub. No.: WO2009/021351

PCT Pub. Date: Feb. 19, 2009

(65) Prior Publication Data

US 2011/0259046 A1 Oct. 27, 2011

(51) Int. Cl.
*F25J 3/04* (2006.01)

(52) U.S. Cl.
USPC ..... 62/644; 62/643

(58) Field of Classification Search
USPC ..... 62/644, 652, 649, 650, 647, 646
See application file for complete search history.

(56) References Cited

U.S. PATENT DOCUMENTS

| | | | | |
|---|---|---|---|---|
| 5,355,681 | A * | 10/1994 | Xu | 62/646 |
| 5,907,959 | A | 6/1999 | Agrawal et al. | |
| 6,962,062 | B2 | 11/2005 | Ha et al. | |
| 7,533,540 | B2 * | 5/2009 | Prosser | 62/645 |
| 2007/0209389 | A1 * | 9/2007 | Prosser | 62/643 |
| 2008/0134718 | A1 * | 6/2008 | Howard et al. | 62/643 |

OTHER PUBLICATIONS

Search Report for PCT/CN2007/002405.

* cited by examiner

*Primary Examiner* — Frantz Jules
*Assistant Examiner* — Brian King
(74) *Attorney, Agent, or Firm* — Justin K. Murray; Elwood L. Haynes

(57) ABSTRACT

A process for producing a gaseous component of air under pressure by cryogenic separation is provided.

10 Claims, 1 Drawing Sheet

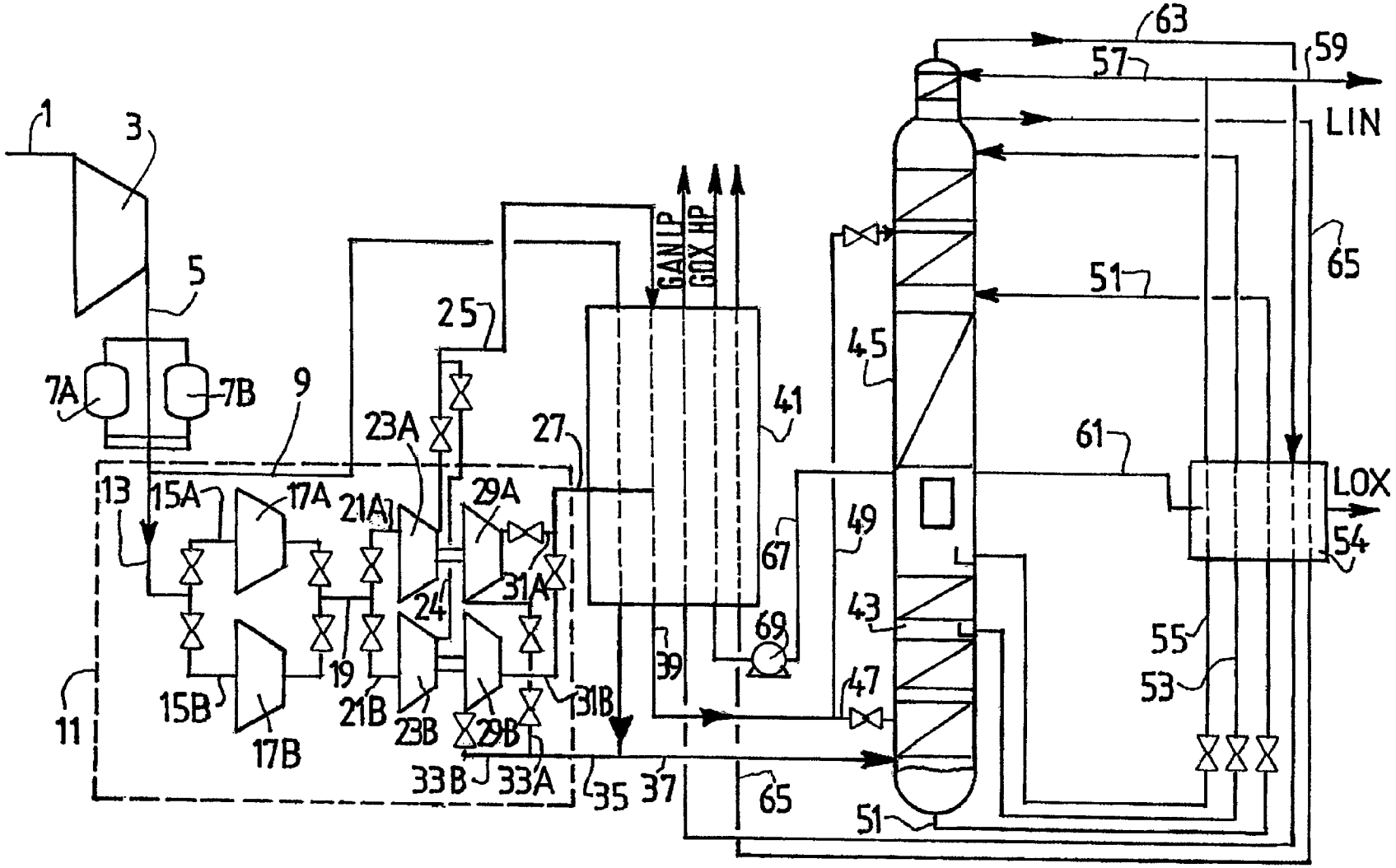
LIN
LOX
GAN LP
GOX HP

PROCESS AND APPARATUS FOR THE SEPARATION OF AIR BY CRYOGENIC DISTILLATION

This application is a §371 of International PCT Application PCT/CN2007/002405, filed Aug. 10, 2007.

FIELD OF THE INVENTION

The present invention relates to the separation of air by cryogenic distillation.

In particular, it relates to a process for producing a gaseous component of air under pressure by cryogenic separation.

BACKGROUND

It is frequently required that an air separation unit producing a gaseous component of air under pressure should also produce a varying amount of a component of air in liquid form.

It is known to supply this requirement by having an air separation unit to produce the gaseous component under pressure, the air separation unit being associated with a liquefier to liquefy varying amounts of gas from the air separation unit to produce the liquid. This apparatus involves considerable capital expenditure.

According to the invention, there is provided a new process scheme which operates efficiently in the gas mode and the liquid mode whilst involving only reasonable investment costs.

All percentages mentioned are molar percentages.

SUMMARY OF THE INVENTION

According to one aspect of the invention, there is provided a process for the separation of air by cryogenic distillation in a distillation system including at least a high pressure column and a low pressure column wherein air is compressed in a main compressor, compressed air is cooled in a heat exchange line, cooled, compressed and purified air is sent from the heat exchange line to the high pressure column, an oxygen enriched liquid stream is sent from the high pressure column to the low pressure column, directly or indirectly, a nitrogen enriched liquid stream is sent from the high pressure column to the low pressure column, a nitrogen rich gas is removed from the low pressure column and warmed in a heat exchange line, a component of air is removed from the distillation system in liquid form, pressurized and warmed in the heat exchange line, wherein:

i) in a first mode of operation, at least 90% of the air compressed in the main compressor is further compressed to a first pressure at least 30 bars higher than the pressure of the high pressure column, the air at the first pressure is sent to the heat exchange line, cooled and divided in two, one part being liquefied and sent to the distillation system and one part being expanded in at least one turboexpander before being sent to the high pressure column ii) in a second mode of operation, at most 70% of the air compressed in the main compressor is further compressed to a first pressure at least 30 bars higher than the pressure of the high pressure column, the air at the first pressure is sent to the heat exchange line, cooled and divided in two, one part being liquefied and sent to the distillation system and one part being expanded in at least one turboexpander before being sent to the high pressure column and at least 30% of the air compressed in the main compressor is sent at the outlet pressure of the main compressor to the heat exchange line, cooled and sent to the high pressure column.

According to further optional aspects of the invention:

- the component of air is removed from the distillation system in liquid form, pressurized and warmed in the heat exchange line is oxygen or nitrogen;
- the air compressed to the first pressure is compressed in at least one compressor of pair of compressors connected in parallel;
- the air expanded from the first pressure to the pressure of the high pressure column is expanded in at least one of two turboexpanders connected in parallel;
- during the first mode of operation the air is sent to both of the compressors connected in parallel and to both of the expanders connected in parallel;
- during the second mode of operation the air is sent to only one of the compressors connected in parallel and to only one of the expanders connected in parallel;
- more cryogenic liquid is produced as a final product during the first mode of operation than in the second mode of operation;
- a cryogenic liquid is produced as a final product only during the first mode of operation.

According to a further aspect of the invention, there is provided an apparatus for the separation of air by cryogenic distillation comprising a main compressor, a heat exchange line, a distillation system comprising at least a high pressure column and a low pressure column, a conduit connecting the outlet of the main compressor with the heat exchange line and the heat exchange line with the high pressure column, adapted to transfer gaseous air to the high pressure column at the outlet pressure of the main compressor, the outlet of the main compressor being connected with at least one booster compressor, the outlet of the booster compressor being connected to the heat exchange line and the heat exchange line being connected to the distillation system via expansion means such that the air at the outlet pressure of the booster compressor is cooled at that pressure and then expanded to a pressure of one of the columns of the distillation system.

Preferably the expansion means comprises two turboexpanders connected in parallel and/or the booster compressor comprises at least one pair of compressors connected in parallel.

The booster compressor may comprise two pairs of compressors connected in parallel. Whilst all four compressors of the booster compressor function in liquid mode, only one compressor of each parallel pair functions in gas mode.

BRIEF DESCRIPTION OF THE FIGURES

The sole FIGURE illustrates one embodiment of the present invention.

DETAILED DESCRIPTION OF THE INVENTION

For a further understanding of the nature and objects for the present invention, reference should be made to the detailed description, taken in conjunction with the accompanying drawing, in which like elements are given the same or analogous reference numbers and wherein:

The process will be described in more detail by referring to the FIGURE which shows an air separation unit according to the invention.

The air separation unit uses a double column comprises a high pressure column 43 operating at about 5.5 bars abs. and thermally connected to a low pressure column 45.

According to all modes of operation, all the air for the distillation is compressed in compressor 3 to around 6 bars abs, purified in purification unit 7A, 7B as stream 5.

Rich liquid 51, poor liquid 53 and very poor liquid are removed from the high pressure column, subcooled in exchanger 53 and sent as reflux to the low pressure column 45.

A pure nitrogen stream 63 is removed from the very top of the low pressure column minaret, warmed in subcooler 53 and then warmed in heat exchanger 41.

A nitrogen waste stream 65 is removed from the bottom of the minaret of the low pressure column, warmed in subcooler 53 and then warmed in heat exchanger 41.

A liquid oxygen stream 67 is removed from the low pressure column 45, compressed in pump 69 and then vaporized in heat exchanger 41 to form a product.

In gas mode, the stream 5 is divided in two. 40 mol. % of the air as stream 9 is sent to the heat exchanger 41, cooled by passing through the whole heat exchanger and then sent to the high pressure column in gaseous form as part of stream 37. The rest of the air (ie, 60 mol. % of the air) forms stream 13 and is boosted up to 50 bar abs by one of the two boosters 17A, 17B in parallel as stream 15A or 15B and then by one of the two boosters 23A, 23B in parallel as stream 21A or 21B. Stream 21A or 21B then forms stream 25, which is cooled in the heat exchanger to an intermediate temperature then divided in two. Stream 39 continues to be cooled in the heat exchanger 41. Stream 27 is removed, and expanded to the pressure of the high pressure column 32 in one of expanders 29A, 29B mounted in parallel. Expander 29A is coupled to booster 23A and expander 29B is coupled to booster 23B. The expanded stream 33A or 33B forms stream 35 and is sent to the high pressure column. The stream is expanded in an expander coupled to the compressor in which it was previously compressed.

In liquid mode, all of the air from compressor 3 forms stream 13 and is boosted up to 50 bar abs by two boosters 17A, 17B in parallel as streams 15A, 15B and then by the two boosters 23A,23B in parallel as streams 21A, 21B. There is no stream 9. Streams 21A and 21B are then mixed to form stream 25, which is cooled in the heat exchanger to an intermediate temperature then divided in two. Stream 39 continues to be cooled in the heat exchanger 41. Stream 27 is removed and split in two. Streams 31A, 31B are each expanded to the pressure of the high pressure column 32 in expanders 29A, 29B mounted in parallel. Expanders 29A is coupled to booster 23A and expander 29B is coupled to booster 23B. The expanded streams 33A, 33B are mixed to form stream 35 and sent to the high pressure column 43, forming the only gaseous stream sent to that column.

In the liquid mode, the total amount of liquid withdrawn as a final product, be it as liquid oxygen 61 or liquid nitrogen 59, is greater than the amount of liquid withdrawn as a final product in the gas mode.

The amount of liquid produced in the liquid mode can reach 50 mol % of the total products for a given air separation unit operating according to the invention.

In addition to that, in either mode, high pressure gaseous nitrogen can be produced by pumping liquid nitrogen and vaporizing it (forming up to 55 mol. % of the gaseous oxygen flow) to improve the specific power consumption.

Variants of the process including an intermediate pressure column, a mixing column and/or an argon column can of course be envisaged.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A process for the separation of air by cryogenic distillation in a distillation system including at least a high pressure column and a low pressure column having a first mode of operation and a second mode of operation that are different from each other, the process comprising the steps of:

purifying an inlet air stream, compressing the purified air stream in a main compressor, cooling the compressed air stream in a heat exchange line, sending the cooled, compressed and purified air stream from the heat exchange line to the high pressure column, sending an oxygen enriched liquid stream from the high pressure column to the low pressure column, sending a nitrogen enriched liquid stream from the high pressure column to the low pressure column, removing a nitrogen rich gas from the low pressure column and warming the removed nitrogen rich gas a heat exchange line, removing a component of air from the distillation system in liquid form, and pressurizing and warming the removed component of air in the heat exchange line, wherein:

i) in the first mode of operation, at least 90% of the air compressed in the main compressor is further compressed to a first pressure at least 30 bars higher than the pressure of the high pressure column, the air at the first pressure is sent to the heat exchange line, cooled and divided in two parts, the first part being liquefied and sent to the distillation system and the second part being expanded in at least one of two turboexpanders connected in parallel—before being sent to the high pressure column;

in the second mode of operation, at most 70% of the air compressed in the main compressor is further compressed to a first pressure at least 30 bars higher than the pressure of the high pressure column, the air at the first pressure is sent to the heat exchange line, cooled and divided in two parts, the first part being liquefied and sent to the distillation system and the second part being expanded in at least one of two turboexpanders connected in parallel before being sent to the high pressure column and at least 30% of the air compressed in the main compressor is sent at the outlet pressure of the main compressor to the heat exchange line, cooled and sent to the high pressure column, wherein connected in parallel is characterized as the two turboexpanders being configured to receive the air at substantially the same temperature and pressure whenever air is introduced to both turboexpanders, wherein a cryogenic liquid is produced as a final product only during the first mode of operation.

2. The process of claim 1 wherein the component of air is removed from the distillation system in liquid form, pressurized and warmed in the heat exchange line is oxygen or nitrogen.

3. The process of claim 1 wherein the air compressed to the first pressure is compressed in at least one compressor of a pair of compressors connected in parallel.

4. The process of claim 3 wherein during the first mode of operation the air is sent to both of the compressors connected in parallel.

5. The process of claim 1 wherein during the first mode of operation the air is sent to both of the turboexpanders in parallel.

6. The process of claim 3 wherein during the second mode of operation the air is sent to only one of the compressors connected in parallel.

7. The process of claim 1 wherein during the second mode of operation the air is sent to only one of the turboexpanders connected in parallel.

8. The process of claim 1, wherein the component of air removed from the distillation system in liquid form comprises liquid nitrogen.

9. The process of claim 1, wherein the component of air removed from the distillation system in liquid form comprises liquid oxygen.

10. The process of claim 1, wherein the component of air removed from the distillation system in liquid form includes a liquid selected from the group consisting of liquid nitrogen, liquid oxygen and combinations thereof.

* * * * *